United States Patent [19]

Kamiyama

[11] Patent Number: 4,623,260

[45] Date of Patent: Nov. 18, 1986

[54] ELECTRONIC TIMEPIECE WITH A CHRONOGRAPH SYSTEM

[75] Inventor: Yasuo Kamiyama, Tanashi, Japan

[73] Assignee: Citizen Watch Co., Ltd., Tokyo, Japan

[21] Appl. No.: 777,018

[22] Filed: Sep. 17, 1985

[30] Foreign Application Priority Data

Sep. 18, 1984 [JP] Japan ..... 59-195483

[51] Int. Cl.[4] ..... G04B 19/04; G04F 8/00

[52] U.S. Cl. ..... 368/80; 368/110; 368/113

[58] Field of Search ..... 368/76, 80, 107, 110–113

[56] References Cited

U.S. PATENT DOCUMENTS

| | | | |
|---|---|---|---|
| 3,884,035 | 5/1975 | Jeannet et al. | 368/110 X |
| 4,270,197 | 5/1981 | Minowa | 368/113 X |
| 4,364,669 | 12/1982 | Thoenig et al. | 368/111 |
| 4,523,857 | 6/1985 | Ushikoshi | 368/107 X |
| 4,537,514 | 8/1985 | Moriya | 368/107 |

*Primary Examiner*—Vit W. Miska

*Attorney, Agent, or Firm*—Birch, Stewart, Kolasch & Birch

[57] ABSTRACT

An electronic watch with a chronograph system has a second hand for displaying the normal time and chronograph time, minute and hour hands for the normal time, a chronograph minute hand and a chronograph hour hand. The watch has a first motor for driving the second hand, a second motor for driving the minute hand and hour hand, and a gear train for transmitting the output of the first motor to the second hand, chronograph minute hand, and chronograph hour hand. A resetting mechanism is provided for resetting the chronograph minute hand and chronograph hour hand to respective zero positions. A first circuit means operates the first motor to reset the second hand to the zero position, and a second circuit means operates for starting and stopping the first motor. The resetting mechanism, first and second circuit means are operated by external manipulating means, thereby changing a normal time display mode to a chronograph time display mode.

6 Claims, 15 Drawing Figures

ELECTRONIC TIMEPIECE WITH A CHRONOGRAPH SYSTEM

BACKGROUND OF THE INVENTION

The present invention relates to an electronic watch with a chronograph system having an analog time-display.

In a conventional analog watch with a chronograph system, a resetting mechanism is provided for each chronograph device, such as the hour-hand shaft, minute-hand shaft, and second-hand shaft. The resetting mechanism comprises a heartcam secured to a corresponding shaft, a hammer adapted to be engaged with the heart to rotate the hand on the shaft to the zero position, and a slipping mechanism for allowing the shaft to rotate to the zero position. Such a mechanism renders the construction of the chronograph system complicated and thick. In order to simplify the construction and to reduce the thickness, a motor is provided for each chronograph device. Each motor is adapted to be electrically controlled so as to be started, stopped, and reset to the zero position.

However, such a system causes the cost of the watch to rise. In addition, each hand must be reset to the zero position by operation of its respective motor. It is desirable to quickly return each hand to the zero position. However, it takes a long time to reset the minute hand and hour hand to zero positions by motors which are operated pulses, because the motors for watches can not be operated by at very high speed. In order to rotate the minute hand at a high speed, it is proposed to rotate the hand one step for each one (minute) pulse. By such a driving system, although the minute hand is reset at a high speed by high frequency pulses, it is difficult to exactly stop the minute hand at a desired position by such a large step driving in the chronograph time mode. More particularly, if the hand stops at a position deviated from an index, which is caused, for example, by eccentric disposition of wheels by error, the user might misread the chronograph time.

SUMMARY OF THE INVENTION

An object of the present invention is to provide a chronograph system which may be operated by one motor, whereby the system may be simplified in construction and manufactured at a low cost.

Another object of the present invention is to provide a system in which a chronograph minute hand and hour hand may be quickly reset to the zero position by mechanical resetting means and may be exactly positioned at desired positions, whereby the user can easily can accurately read the chronograph time.

To those ends, there is provided an electronic timepiece with a chronograph system having second, minute and hour hands, a chronograph minute hand and a chronograph hour hand, comprising, a first motor for driving the second hand and for displaying the normal time and the chronograph time, and a second motor for driving the minute hand and hour hand. A gear train is provided for transmitting the output of the first motor to the second hand, chronograph minute hand, and chronograph hour hand, and a resetting mechanism is provided for resetting the chronograph minute hand and chronograph hour hand to their respective zero positions. The resetting mechanism comprises hearts secured to shafts of respective hands, a fly-back lever engaged with the hearts for rotating the hands to the zero positions, and slipping mechanisms for allowing the resetting operation. An electric circuit comprises first circuit means for operating the first motor to reset the second hand to the zero position, and second circuit means for starting and stopping the first motor. External manipulating means is provided for operating the resetting mechanism, first and second circuit means and for changing a normal time display mode to a chronograph time display mode. The external manipulating means includes a changeover switch for alternately changing the normal time display mode and the chronograph reset state, and includes a start/stop switch for alternately starting and stopping the chronograph operation.

These and other objects and features of the present invention will become more apparent from the following description with reference to the accompanying drawings.

DESCRIPTION OF THE PREFERRED EMBODIMENT

Figure 1:
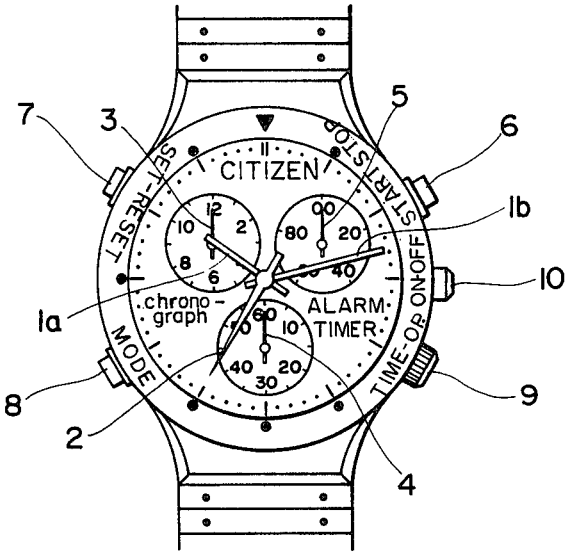
FIG. 1 is a plan view of an analog time-display electronic watch with a chronograph system.

Referring to FIG. 1, an analog time-display electronic watch with a chronograph system comprises an hourhand 1*a* and a minute hand 1*b* for indicating the normal standard time and alarm time, and a second hand 2 for indicating both the normal time and chronograph time. A chronograph (CG) hour hand 3 indicates hour of chronograph time and rotates one revolution per 12 hours. A chronograph (CG) minute hand 4 indicates minute of the chronograph time and makes one rotation 60 minutes. A chronograph (hereinafter called CG) 2/100-second hand 5 indicates 2/100 second of the chronograph time and makes per rotation one second at the rate of one step per 1/50 second. Further, the watch can be used as a timer. In timer operation, the CG 2/100-second hand 5 is adapted to indicate a residual time of set timer. The timer is so arranged as to set a maximum time of 49 minutes. The watch is provided with external manipulating means.

The external manipulating means comprises a start/stop button 6 for causing the start and stop of the chronograph and the timer, a set/reset button 7 for causing the reset of the chronograph and set of the timer, and a changeover button 8 for changing the normal time indicating mode to the chronograph time indicating mode. A crown 9 is normally positioned at an innermost position and is adapted to be axially pulled to an intermediate position and an outermost position. When the crown 9 is rotated clockwise or counterclockwise at the outermost position, the normal time indicated by hour and minute hands 1*a*, 1*b* is set. At the intermediate position, the system is changed to the alarm time setting state. By rotating the crown 9 clockwise or counterclockwise, the alarm time can be set. An alarm button 10 is provided for switching the alarm on and off. When the alarm button 10 is at a pushed position, the alarm is off. At a pulled position, the alarm is on.

When the crown 9 is at the innermost position, the normal time is indicated by the hour hand 1*a*, minute hand 1*b*, and second hand 2. The CG hour hand 3, minute hand 4, and 2/100-second hand 5 are respectively positioned at zero positions.

When the chronograph system is used, the changeover button 8 is pushed once. The second hand 2 is rotated by a motor at high speed, for example 64 Hz pulses, to the zero second position so that the system is changed to the chronograph mode. When the start/stop button 6 is pushed, the CG 2/100-second hand 5 starts rotating at the rate of 2/100 second step by a sole motor. At the same time, the second hand 2 is driven as a CG second hand at the rate of one second step by a common motor. Further, the CG minute hand 4 and CG hour hand 3, which are connected with the second hand 2 through gear trains, as hereinafter described, start rotating at the rate of one second step to make one rotation every 60 minutes and one rotation every 12 hours, respectively. When the start/stop button 6 is pushed again, CG hands 2, 3, 4 and 5 are stopped to indicate the elapsed time.

In order to continue the chronograph time measurement, the button 6 is pushed again, and chronograph operations are repeated in the same manner as described above so that the elapsed time is indicated.

When the set/reset button 7 is pushed, while each of the CG hands is at a stop, CG hour and minute hands 3 and 4 are driven to the zero positions and the second hand 2 and CG 2/100-second hand 5 are quickly rotated to the zero second positions at 64 Hz. Thus, the system is set for chronograph reuse. By pushing the start/stop button 6, the chronograph system restarts for measurement of time.

After the chronograph operation is finished, when the changeover button 8 is pushed, CG minute and hour hands 4, 3 are driven to the zero positions and the second hand 2 is quickly returned to the second time indicating position of the normal time at 64 Hz. Thus, the second hand 2 indicates the second of the normal time. The change to normal time can be achieved if the chronograph system is operated or at a stop.

In order to use the timer, the set/reset button 7 is pushed in the normal time indicating state. The timer is indicated by the CG 2/100-second hand 5. The hand 5 is rotated by one minute at every push of the set/reset button 7, and 49 minutes can be set in the timer. After setting a desired time, pushing of the start/stop button 6 causes the timer to start. The CG 2/100-second hand 5 is driven at the rate of one step per one minute and the alarm is activated at the set time. Even if the timer is set, unless the button 6 is pushed, the hand 5 does not move. In order to prevent misoperation of the timer, pushing of the set/reset button 7 during the timer operation does not cause the timer to be reset.

Further, the CG 2/100-second hand 5 can also be used as a modulo-50 counter which integrately counts one by one by pushing the set/reset button 7.

Figure 2:
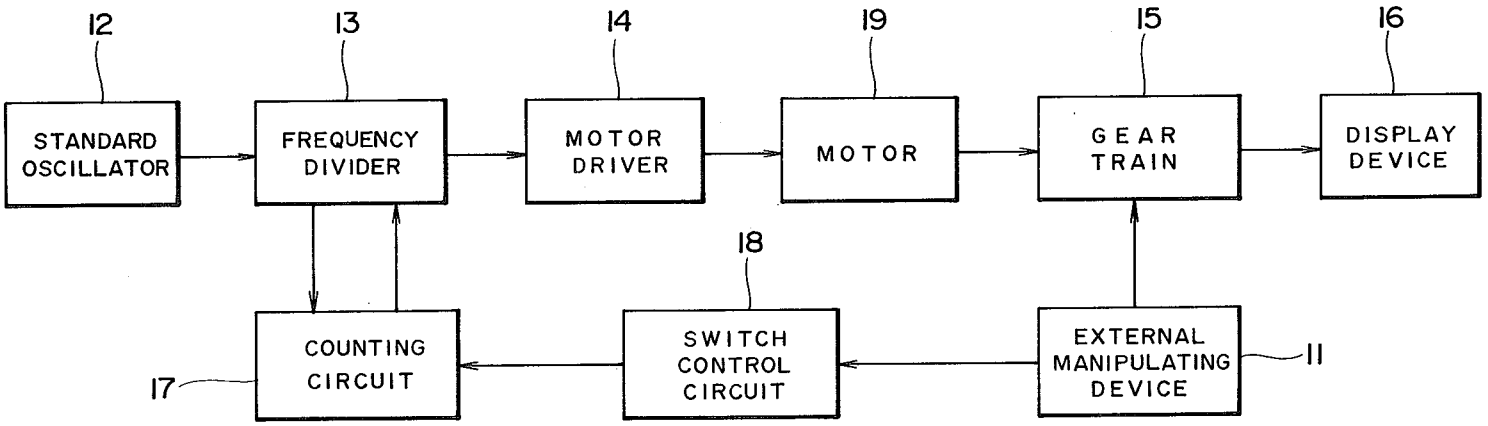
FIG. 2 is a schematic block diagram showing a part of a watch system.

FIG. 2 shows a schematic block diagram of a watch system according to the present invention. The system comprises a standard oscillator 12 comprising a crystal oscillator, a signal of which is divided into predetermined frequencies by a frequency divider 13. One of the divided signals from the divider 13 is applied to a display device 16 through a motor driver 14, a motor 19, and a gear train 15 to indicate the normal time, in the same manner as a conventional analog time-display watch. The divider 13 and a counting circuit 17 apply signals to each other. External manipulating means 11 which includes push buttons 6, 7, 8 and 10 and crown 9 is provided to control the gear train 15 and a switch control circuit 18. The counting circuit 17 is controlled by a signal from the switch control circuit 18.

Figure 3:
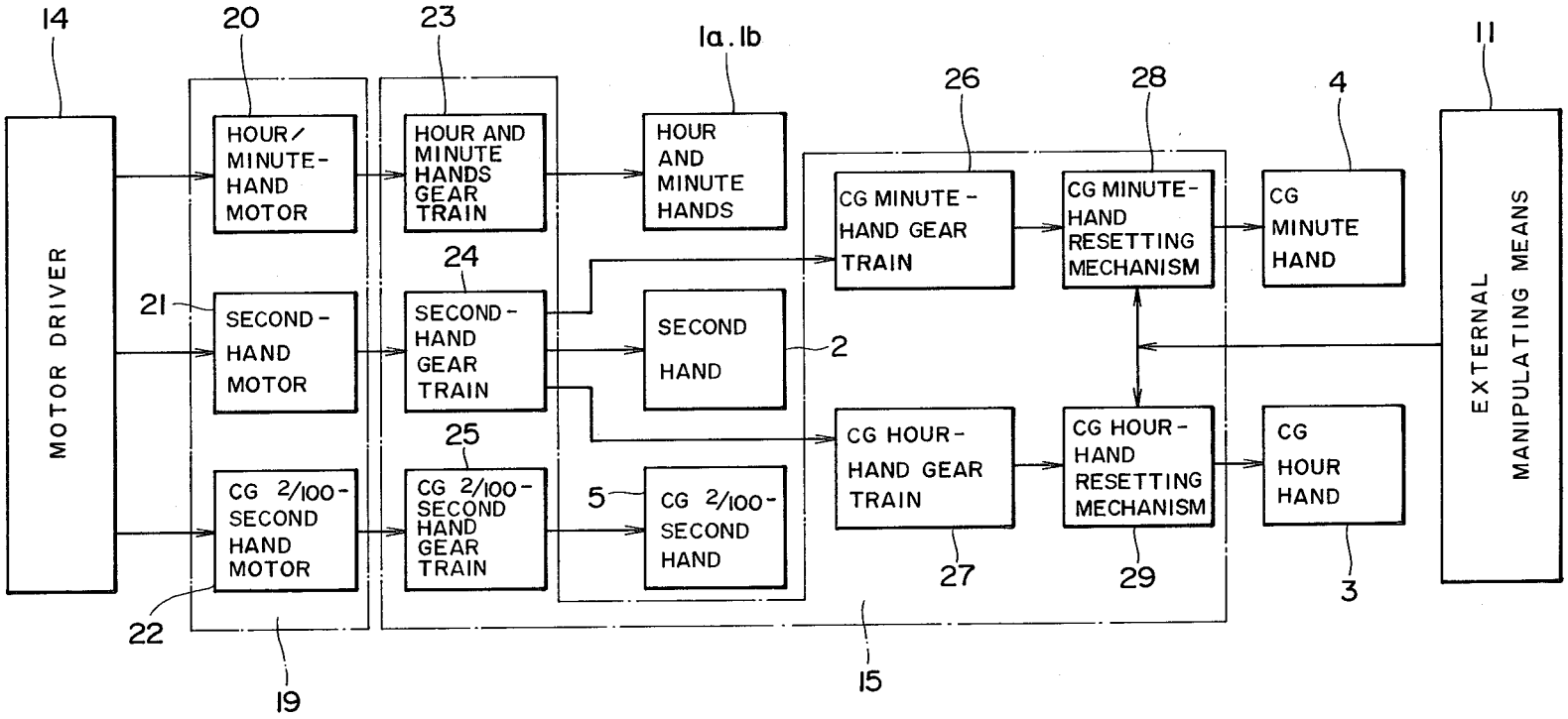
FIG. 3 is a schematic block diagram showing a part of gear train construction.

FIG. 3 is a schematic block diagram showing the relationship between external manipulating means 11 and gear train 15. The motor 19 includes an hour/minute-hand motor 20 for driving hour and minute hands 1*a*, 1*b* through an hour and minute hands gear train 23, a second-hand motor 21 for driving the second hand 2 through a second-hand gear train 24, and a CG 2/100-second hand motor 22 for driving the CG 2/100-second hand 5 through a CG 2/100-second hand gear train 25. Those motors 20, 21 and 22 are driven by the motor driver 14. When the chronograph system is used, the second-hand gear train 24 driven by the motor 21 is adapted to cooperate with a CG minute-hand gear train 26 for driving the CG minute hand 4 and a CG hour-hand gear train 27 for driving the CG hour hand 3. A CG minute-hand resetting mechanism 28 is provided between the CG minute-hand gear train 26 and CG minute hand 4, and a CG hour-hand resetting mechanism 29 is provided between the CG hour-hand gear train 27 and CG hour hand 3. These resetting mechanisms 28, 29 are provided for controlling the CG minute hand 4 and the CG hour hand 3, respectively, by operating external manipulating means 11.

Figure 4:
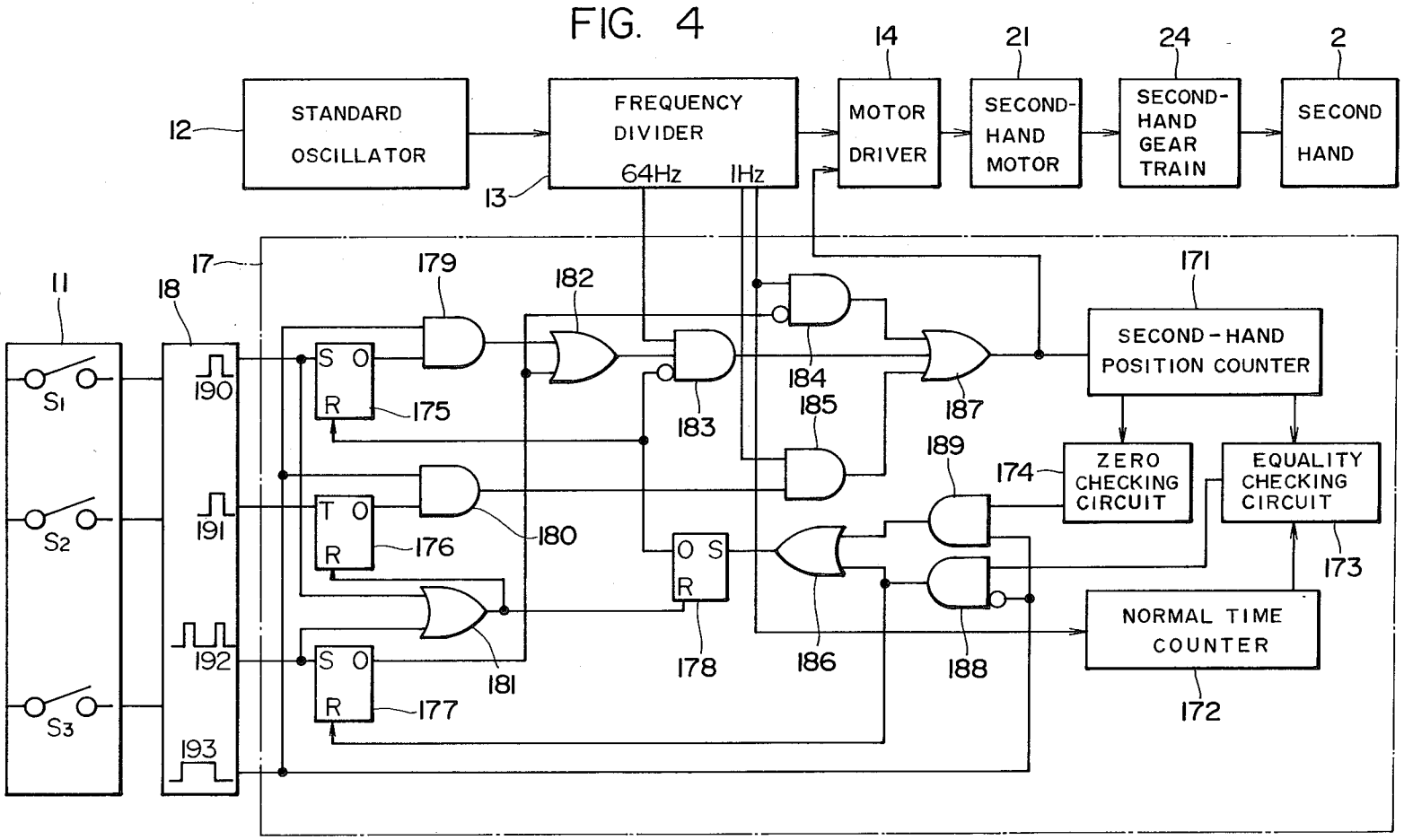
FIG. 4 is a schematic block diagram showing a circuit for the chronograph system.

FIG. 4 is a schematic block diagram showing the relationship between manipulating means 11 and circuit means 17, 18 of FIG. 2. A signal of the standard oscillator 12 forming a time standard signal is applied to the frequency divider 13 to be divided and compounded into a predetermined proper signal, which is applied to the motor driver 14 for driving the second-hand motor 21. The external manipulating means 11 comprises an S/S switch S2 corresponding to the start/stop button 6, an R/S switch S1 corresponding to the set/reset button 7, and a changeover switch S3 corresponding to the changeover button 8. Each of output signals generated from respective switches are applied to the switch control circuit 18. The circuit 18 produces one-shot pulse signals 190 and 191 in response to output signals of R/S switch S1 and S/S switch S2, respectively. Further, the circuit 18 produces a high (H) level signal 193 and one-shot pulse signal 192 in response to the output signal at the close of the changeover switch S3, and produces a low (L) level signal 193 and one-shot pulse signal 192, when the switch S3 is opened.

The counting circuit 17 comprises a second-hand position counting circuit 171 which is a modulo-60 counter, a normal time counter 172 of modulo-60 counter, an equality checking circuit 173, a zero checking circuit 174, RS flip-flops 175, 177 and 178, a T-type flip-flop 176, AND gates 179, 180, 183, 184, 185, 188 and 189, and OR gates 181, 182, 186 and 187. The counter 171 is provided for counting the position of the second hand 2. The normal time counter 172 is provided for counting second time of the normal time. The equality checking circuit 173 produces a signal when the content of the second-hand position counter 171 is equal to that of the normal time counter 172. The zero checking circuit 174 produces an output signal in response to a reset signal of the position counter 171 which is generated when it counts 60. The OR gate 186, AND gates 188 and 189 constitute a selector for selecting the output signal of the equality checking circuit 173 or the output signal of the zero checking circuit 174 in response to the level of the output signal 193 of the changeover switch S3. The output signal of the selector is applied to the RS flip-flop (hereinafter called FF) 178 as a set signal. The RS FF 175 is applied with the signal 190 of the R/S switch S1 and the output signal thereof is applied to the AND gate 179. The T-type FF 176 is applied with the signal 191 of the S/S switch S2 and the output signal thereof is applied to the AND gate 180. AND gates 179 and 180 are controlled by the signal 193 of the changeover switch S3 and output signals thereof are applied to the OR gate 182 and the AND gate 185, respectively. The RS FF 177 is applied with the signal 192 of the changeover switch S3 and the output signal thereof is applied to the OR gate !82 and the AND gate 184. The AND gate 183 is adapted to operate as an inhibit-gate for a 64 Hz signal from the frequency divider 13 according to output signals of the RS FF 178 and OR gate 182. The AND gate 184 is adapted to operate as an inhibit-gate for blocking a 1 Hz signal from the divider 13 according to the output signal of the RS FF 177. The AND gate 185 controls the 1 Hz signal of the divider 13 by the output signal of the AND gate 180.

In the normal time display state, the changeover switch S3 is opened (OFF). Accordingly, the signal 193 is at L-level and an H-level signal is applied to one of the inputs of the AND gate 188. On the other hand, the output of second-hand position counter 171 is equal to that of the time counter 172, so that an H-level output signal of the equality checking circuit 173 is applied to the other input of the AND gate 188. By the output signal of the OR gate 186, the RS FF 178 is set, and by an output signal of the AND gate 188, the RS FF 177 is reset, so that the FF 178 produces an H-level signal and the FF 177 produces an L-level signal. Therefore, the 64 Hz signal of the divider 13 is inhibited by the AND gate 183 and the 1 Hz signal is applied to the AND gate 184, the output signal of which is applied to the motor driver 14 through OR gate 187. Thus, the second-hand motor 21 is driven at 1 Hz to rotate the second hand 2. The second-hand position counter 171 is synchronized with the rotation of the second hand 2 for counting up.

In order to change the system to the chronograph operation mode, the changeover button 8 is pushed to turn on the changeover switch S3. The RS FF 177 is set by the signal 192 to produce an H-level signal. Accordingly, the 1 Hz signal of the divider 13 is inhibited by the AND gate 184 and the output of OR gate 187 changes to an L-level signal. Thus, the driving of second hand 2 at 1 Hz stops and the 1 Hz signal to the second-hand position counter 171 is stopped.

Further, the signal 192 of the switch S3 is sent to the reset terminal of the RS FF 178 through the OR gate 181 so that the RS FF 178 produces an L-level signal. Thus, one of the inputs of the AND gate 183 is applied with an H-level signal and the other input is applied with an H-level signal of the RS FF 177 through the gate 182. Thus, the AND gate 183 produces the 64 Hz pulses. The output signal of the AND gate 183 is applied to the motor driver 14 through the OR gate 187 so that the second-hand motor is driven by the pulses of 64 Hz to rotate the second hand 2 and the second-hand position counter 171 counts up the pulses synchronizing with the rotation of second hand 2.

When the second hand 2 reaches the zero second position and the counter 171 counts up to zero second, the reset signal is produced from the counter. Therefore, the zero checking circuit 174 produces a signal for opening the AND gate 189 which is in waiting state by the H-level signal 193 of the switch S3. The AND gate 189 produces a signal for setting the RS FF 178 through the OR gate 186 and the FF 178 produces an H-level signal for closing the AND gate 183 to inhibit the 64 Hz signal. Thus, the system is changed to the chronograph operation mode and the second hand 2 is located at the zero second position.

When the start/stop button 6 is pushed to turn on the S/S switch S2, the signal 191 is sent to the T-type FF 176 to produce an H-level signal which is applied to the AND gate 18Q which is in a waiting state by the signal 193 of the switch S3. The AND gate 180 produces a signal for opening the AND gate 185. Thus, 1 Hz signal of the gate 185 is applied to the second-hand motor 21 to drive it at 1 Hz for rotating the second hand 2 through the second-hand gear train 24 and indicating second time of the chronograph. The second-hand position counter 171 counts up the 1 Hz pulses in synchronism with the second hand 2. On the other hand, as will be hereinafter described, the CG hour and minute hands 3 and 4 are released and start rotating so that the chronograph operation starts.

In the chronograph operating state, when the start/stop button 6 is pushed again to turn on the S/S switch S2, the T-type FF 176 produces an L-level signal by the signal 191 and the 1 Hz signal by the AND gate 185 is inhibited. Thus, the second hand 2 and second-hand position counter 171 stop operating, and CG hour and minute hands 3, 4 stop rotating. Accordingly, elapsed time can be measured. If start/stop button 6 is depressed again, chronograph restarts. Thus, the start and stop of the chronograph operation is repeated at every pushing of the start/stop button 6.

When the set/reset button 7 is pushed to turn on the R/S switch S1, to generate signal 190, irrespective of chronograph start or stop, the RS FF 175 produces an H-level signal which is applied to the OR gate 182 through the AND gate 179. The OR gate 182 produces an H-level signal which is applied to the AND gate 183. The signal 190 is further applied to the OR gate 181, an output signal of which is applied to reset terminals of FFs 176 and 178. Therefore, the T-type FF 176 produces an L-level signal for closing the ANO gate 180 which produces an L-level signal, so that the 1 Hz signal of the AND gate 185 is stopped. At the same time, the RS FF 178 produces an L-level signal to open the AND gate 183, the 64 Hz signal of which is applied to the second-hand position counter 171 through the OR gate 187.

When the counter 171 counts 60, the zero checking circuit 174 responds to the reset signal of the counter to produce an output signal. By this signal, the AND gate 189 produces an H-level signal to set the RS FF 178, the output signal of which becomes an H-level, so that the 64 Hz signal is stopped by the AND gate 183. Thus, the OR gate 187 produces an L-level signal to stop the second hand 2 at the zero second position. On the other hand, as hereinafter described, CG hour and minute hands 3, 4 are also reset to the zero positions.

In the reset state, when the start/stop button 6 is pushed to turn on the S/S switch S2, the T-type FF 176 produces an H-level signal dependent on the signal 191 and the AND gate 180 produces a signal to open the AND gate 85. Thus, the 1 Hz signal is applied to the second-hand motor 21 to drive it at 1 Hz and rotate the second hand 2 to restart the chronograph operation.

When the changeover button 8 is pushed to turn off the changeover switch S3, irrespective of the start, stop or reset state, the one pulse signal 192 is applied to the reset terminal of the RS FF 178 through the OR gate 181, so that the FF 178 produces an L-level signal. Thus, an H-level signal is applied to the AND gate 183 to produce the 64 Hz signal so that the second hand 2 and second-hand position counter 171 are driven at 64 Hz. On the other hand, the other signal 193 becomes an L-level signal. Thus, regardless of the start or stop of the chronograph, that is regardless of the output signal of the FF 176, the AND gate 180 produces an L-level signal so that the 1 Hz signal for the CG second is stopped by the AND gate 185. On the other hand, CG hour and minute hands 3, 4 are reset to the zero positions, as will be hereinafter described.

When the count of the second-hand position counter 171 coincides with the count of the time counter 172, the equality checking circuit 173 produces an output signal which opens the AND gate 188. The RS FF 178 is set by the output signal of the AND gate 188 and produces an H-level signal. The AND gate 183 is applied with an L-level signal to stop the 64 Hz signal. At the same time, the output signal of AND gate 188 resets the FF 177, causing the output thereof to go to a low level. Thus, AND gate 184 produces the 1 Hz signal for the normal time, so that the second hand 2 is rotated to indicate the normal time. The count of the second-hand position counter 171 coincides with the count of the time counter 172 and the counter 171 continues counting in synchronism with the counter 172.

From the foregoing, it will be seen that the second hand 2 displays both the normal time and the chronograph time by operation of switches connected to buttons 6, 7 and 8 of the external manipulating means 11, and the resetting of the hand 2 is performed at high speed as 64 Hz.

Figure 5A:
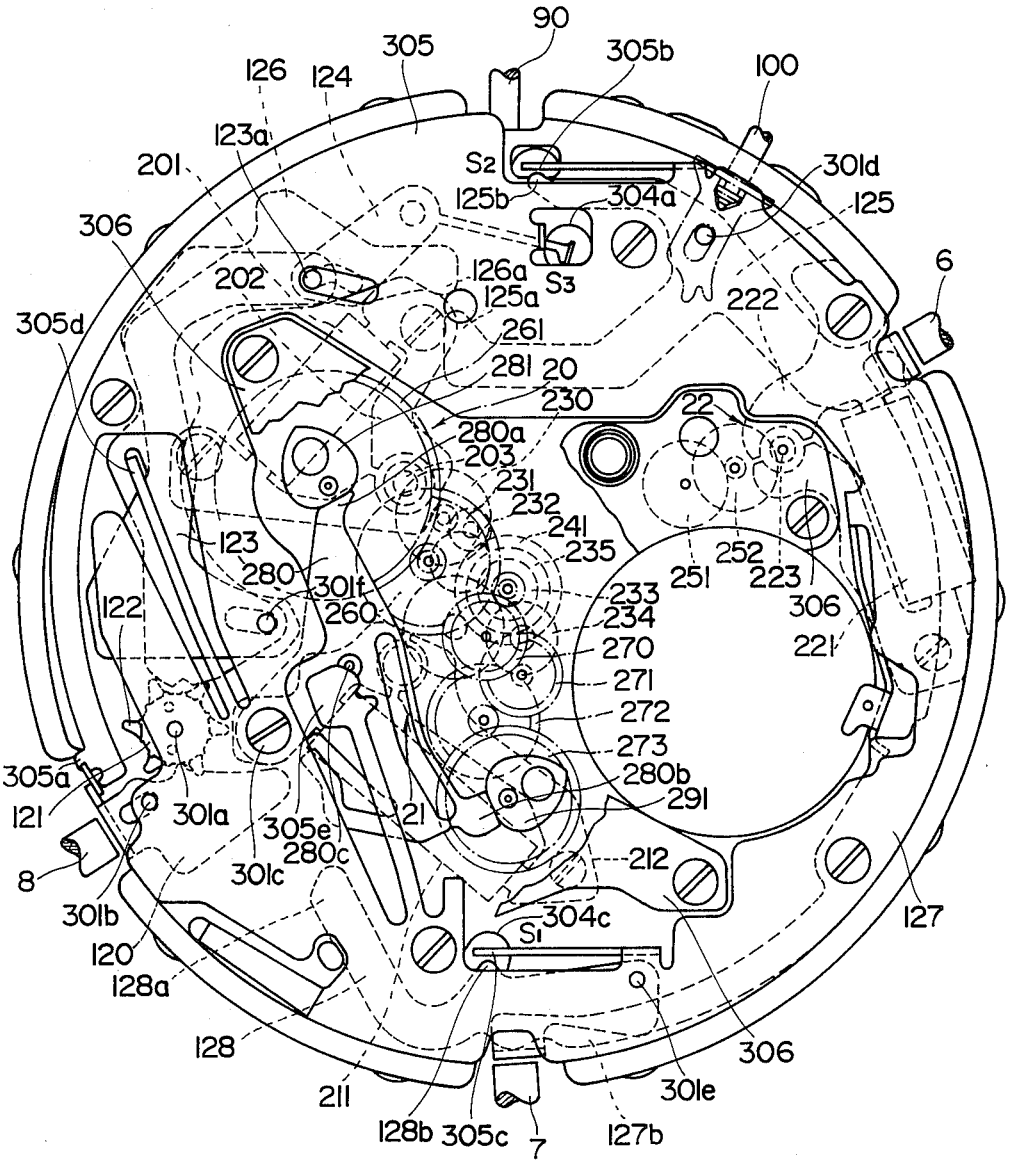
FIG. 5*a* is a schematic plan view of a watch movement.
Figure 5B:
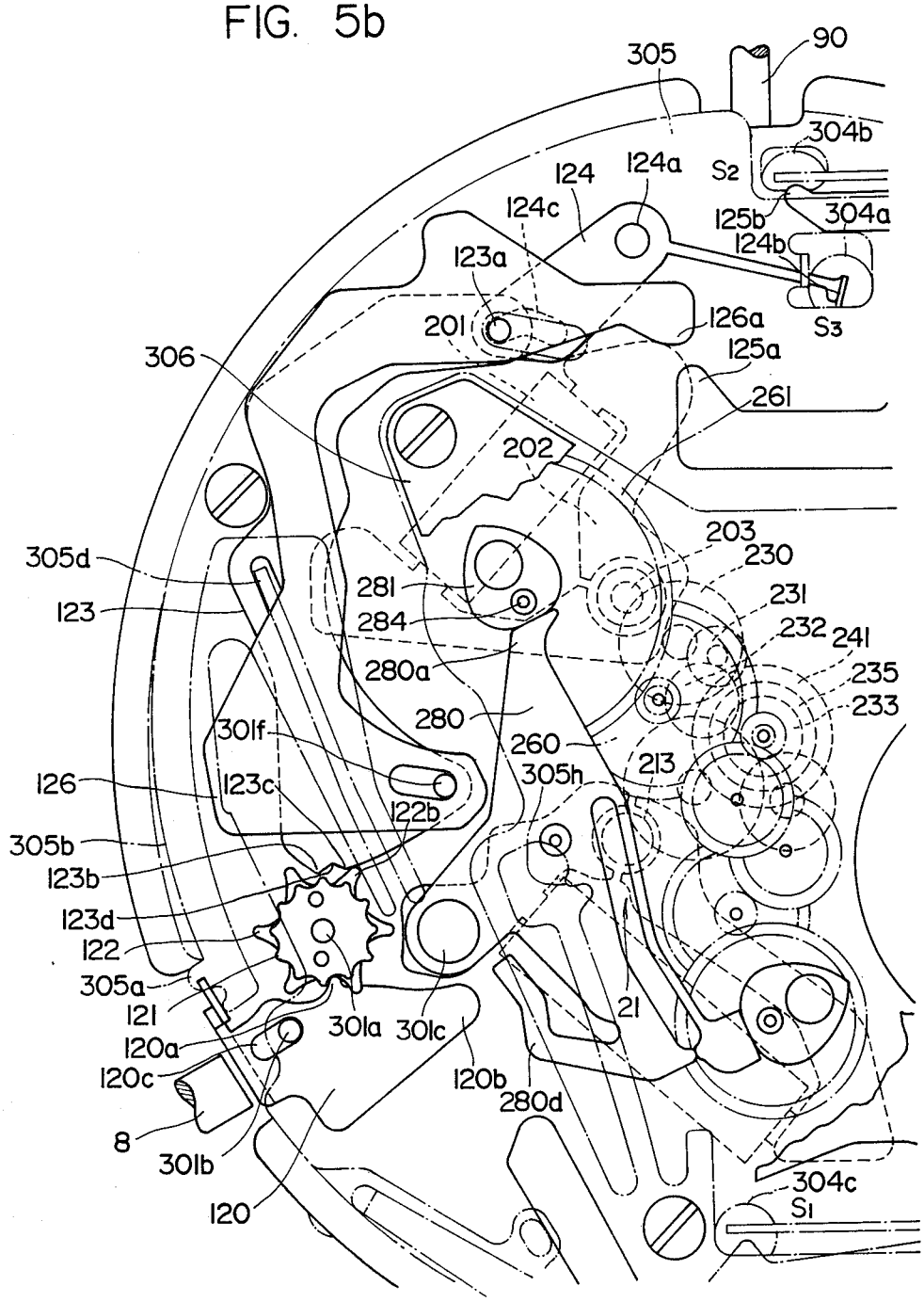
FIG. 5*b* is an enlarged plan view showing a main part of a part of FIG. 5*a;*
Figure 6:
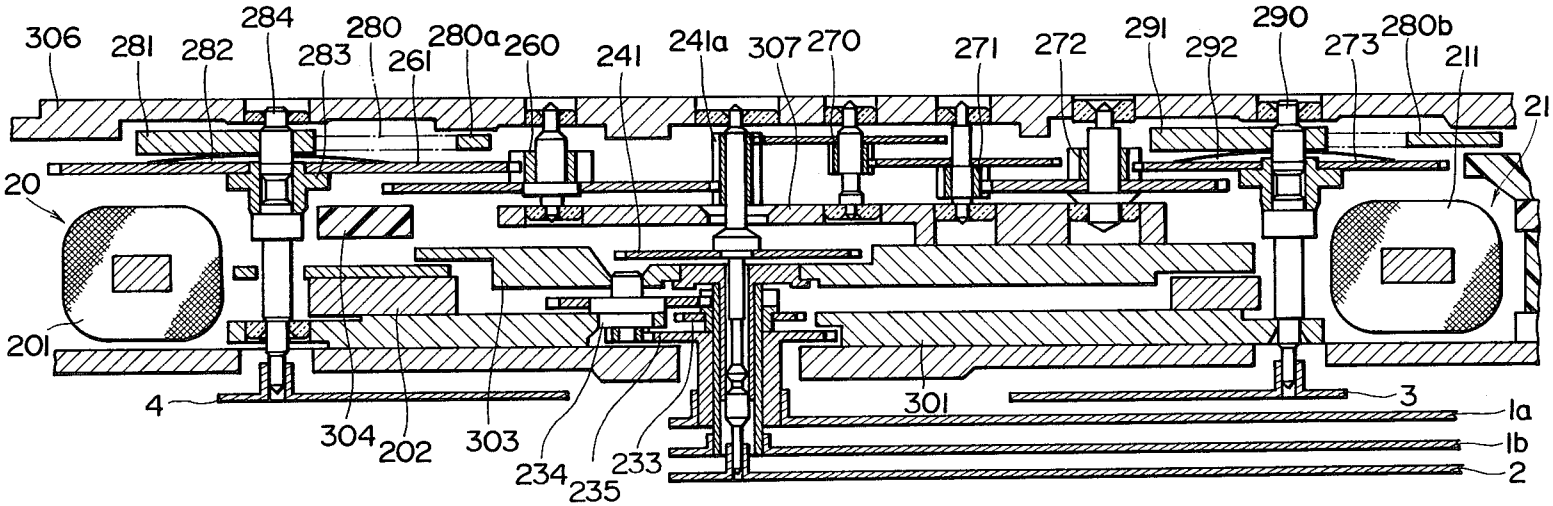
FIGS. 6 to 8 are sectional views showing gear trains of FIG. 5.
Figure 7:
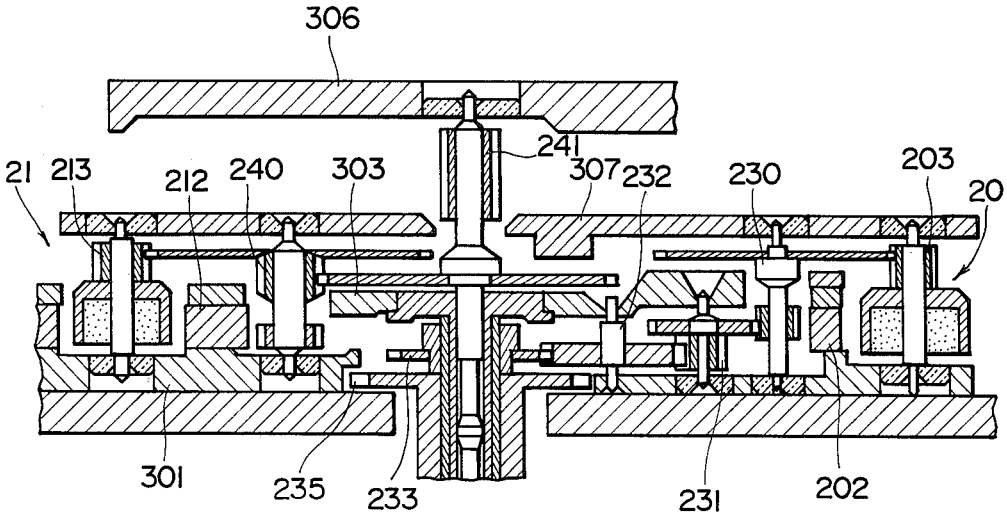

Referring to FIGS. 5 to 8, the second-hand motor 21 comprises a coil 211, stators 212, and rotor 213. Rotation of rotor 213 is transmitted through an intermediate wheel 240 to a second wheel 241 carrying the second hand 2. The intermediate wheel 240 forms the second-gear train 24 (FIG. 3). As shown in FIG. 7, rotor 213 and intermediate wheel 240 are rotatably supported between a plate 301 and a bridge 307.

The hour-minute-hand motor 20 comprises a coil 201, stator 202 and rotor 203. A pinion of the rotor 203 (FIG. 7) engages with a fifth wheel 230 supported between the plate 301 and the bridge 307. The fifth wheel 230 engages with a fourth wheel 231 which in turn meshes with a third wheel 232. The third wheel 232 is engaged with a center wheel 233 carrying the minute hand 1*b*. The rotation of center wheel 233 is transmitted through a minute wheel 234 to an hour wheel 235 carrying the hour hand 1*a*. Thus, these wheels form the hour-minute hands gear train 23.

Figure 8:
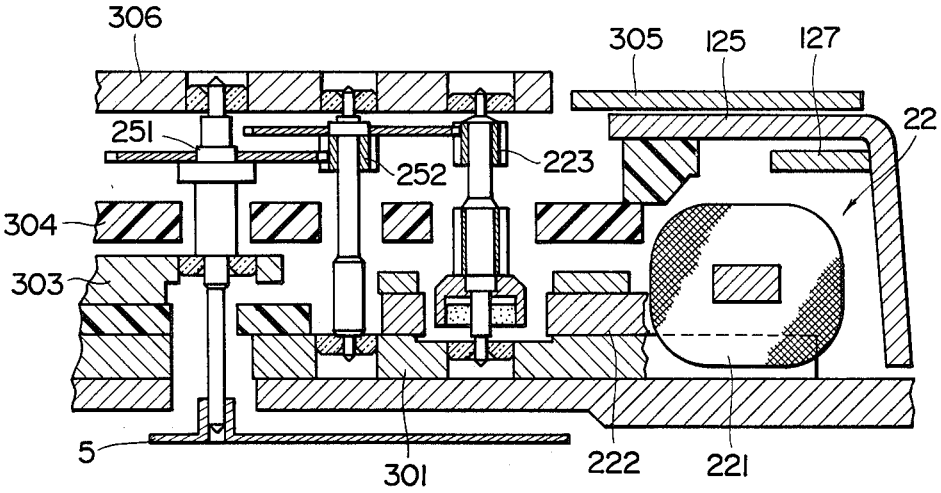
Figure 9:
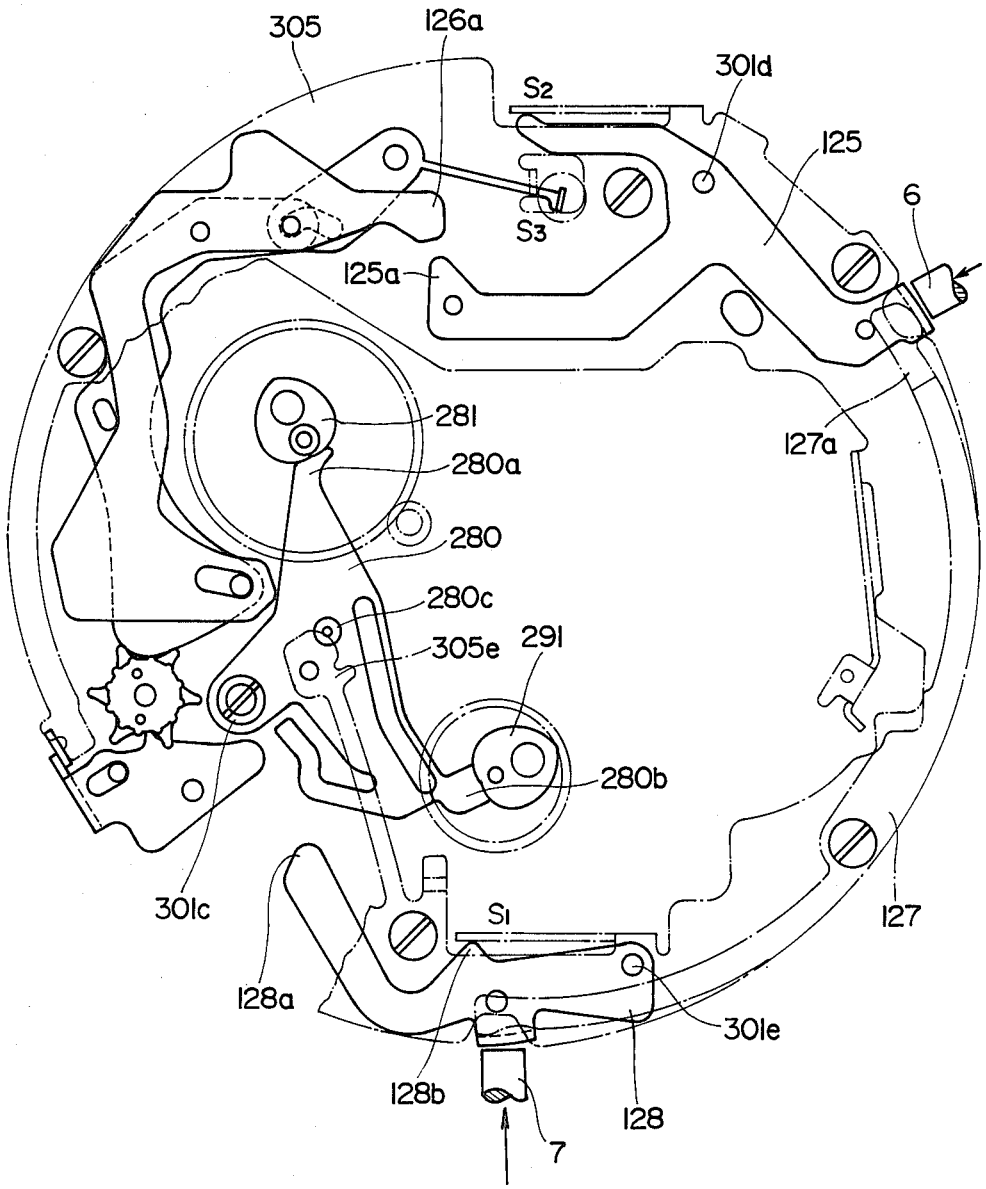
FIGS. 9 to 12 are schematic plan views of the watch movement, in which different operating positions are shown.

Referring to FIG. 8, the CG 2/100-second-hand motor 22 comprises a coil 221, stator 222, and rotor 223. The rotation of the rotor 223 is transmitted to a CG 2/100-second wheel 251 through an intermediate wheel 252 forming the gear train 25. Thus, the CG 2/100-second hand 5 secured to the wheel 251 indicates 2/100 second time during chronograph operation.

As shown in FIG. 6, a pinion 241*a* of second wheel 241 engages with an intermediate wheel 260 forming the CG minute-gear train 26 and with a first intermediate wheel 270. The intermediate wheel 260 meshes with a CG minute gear 261 for rotating a CG minute wheel shaft 284. The first intermediate wheel 270 forms the CG hour-gear train 27 comprising a second intermediate wheel 271 and a third intermediate wheel 272. The third intermediate wheel 272 engages with a CG hour gear 273 for driving a CG hour wheel shaft 290.

Resetting mechanisms 28 and 29 are provided between the CG minute gear 261 and CG minute wheel shaft 284, and between the CG hour gear 273 and the CG hour wheel shaft 290, respectively.

Explaining the construction of the resetting mechanism 28 with reference to FIG. 6, a hub 283 of the CG minute gear 261 is rotatably mounted on the CG minute wheel shaft 284 and a heart 281 is secured to the shaft 284. An initially corned disc spring 282 as a slipping mechanism is provided between the heart 281 and the gear 261 so as to transmit the torque of the gear 261 to the shaft 284. An actuating end 280*a* of a fly-back lever (or hammer) 280 is adapted to be engaged with the heart 281 by operating external actuating members. The fly-back lever 280 is rotatably supported by a pin 301*c* (FIG. 5). When the actuating end 280*a* of the fly-back lever 280 engages with the heart 281, the heart is rotated to the zero minute position so that the shaft 284 is forcibly rotated to the zero position, with slipping of the slipping mechanism by the spring 282. The friction force of the slipping mechanism is selected so that the spring 282 slips without rotating the CG minute gear 261 in the reverse direction. In other words, the CG minute gear 261 continues to rotate, even if the shaft 284 stops. The rotational speed of the rotor 213 of the second-hand motor 21 is reduced to rotate the gear 261, while the torque of the rotor is increased. If the torque at the gear 261 is 3 g.cm, the slip torque (friction force) at the spring 282 is set to about 0.4–0.8 g.cm in order to prevent the reverse rotation of the gear 261. If the slip torque is set to be less than 0.4 g.cm, CG minute hand 4 could be rotated by a shock such as a shock by the fall of the watch, which causes mismeasurement of chronograph time. Such a displacement of the minute hand is caused by the unbalance of the hand and heart cam 281 in weight.

The resetting mechanism 29 for CG hour is the same as the resetting mechanism 28, comprising CG hour wheel shaft 290, heart 291, disc spring 292, and actuating end 280*b* of fly-back lever 280. In the gear train for the CG hour, the torque at the CG hour gear 273 is about 36 g.cm, which is sufficient for preventing reverse rotation of the gear by the slip torque 0.4–0.8 g.cm the slipping mechanism spring 292.

Lever mechanisms for switches S1, S2, S3 and resetting mechanisms 28 and 29 will be described hereinafter with reference to FIGS. 5, and 9 to 14. In the normal time indication mode, actuating ends 280*a* and 280*b* engage with hearts 281 and 291 to keep CG minute hand 3 and hour hand 4 in zero positions, and second hand 2 rotates at 1 Hz. A pin 280*c* of the fly-back lever is engaged with an end portion of a spring arm 305*e* formed in bridge 305, so that the fly-back lever 280 is held so as to keep zero positions of hands 3 and 4. In such a state, switches S1 to S3 are opened.

Figure 13:
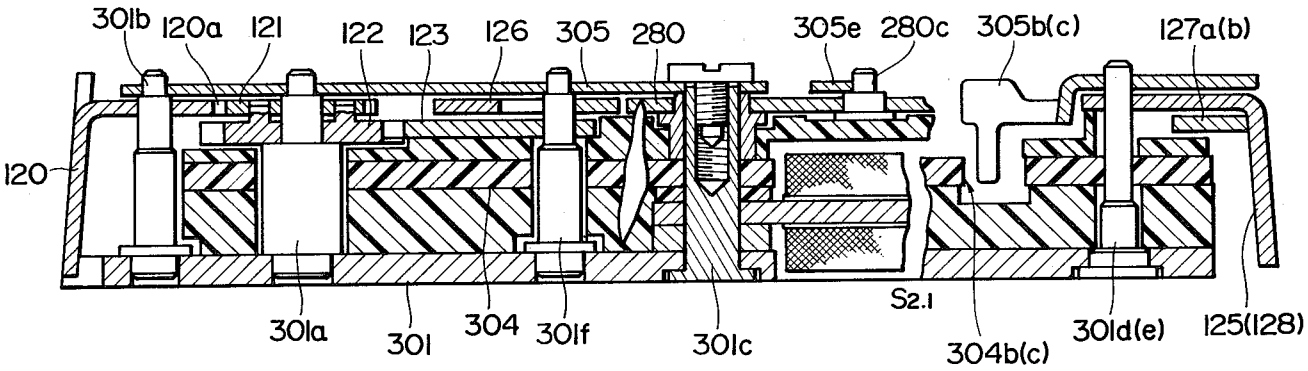
FIGS. 13 and 14 are sectional views of switching mechanisms.
Figure 14:
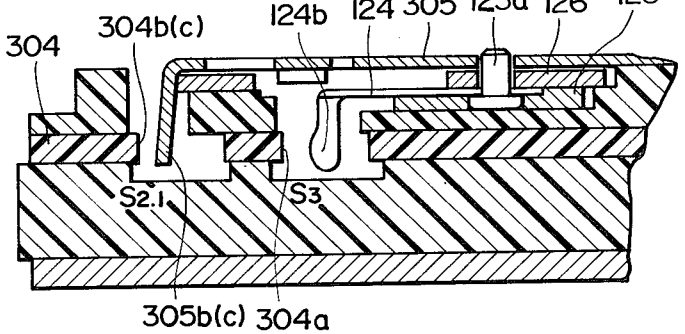

An actuating lever 120 is radially slidably provided by the engagement of a slot 120*c* formed in the lever with a pin 301*b* mounted on plate 301. An end portion 305*a* of a spring arm 305*b* engages with an end of the actuating lever 120 to urge it in the outward direction of the watch. A double rachet wheel comprising an upper wheel 121 and a lower wheel 122 which are integrated with each other is rotatably mounted on a shaft 301*a* secured to the plate 301 (FIG. 13). A pawl 120*a* formed in the actuating lever 120 engages with the upper wheel so as to rotate the double rachet wheel by the movement of the actuating lever 120 toward the center of the watch. The upper wheel 121 has 12 teeth and lower wheel 122 has 6 teeth, so that the lower wheel 122 rotates ½ pitch per stroke of the actuating lever 120.

Figure 10:
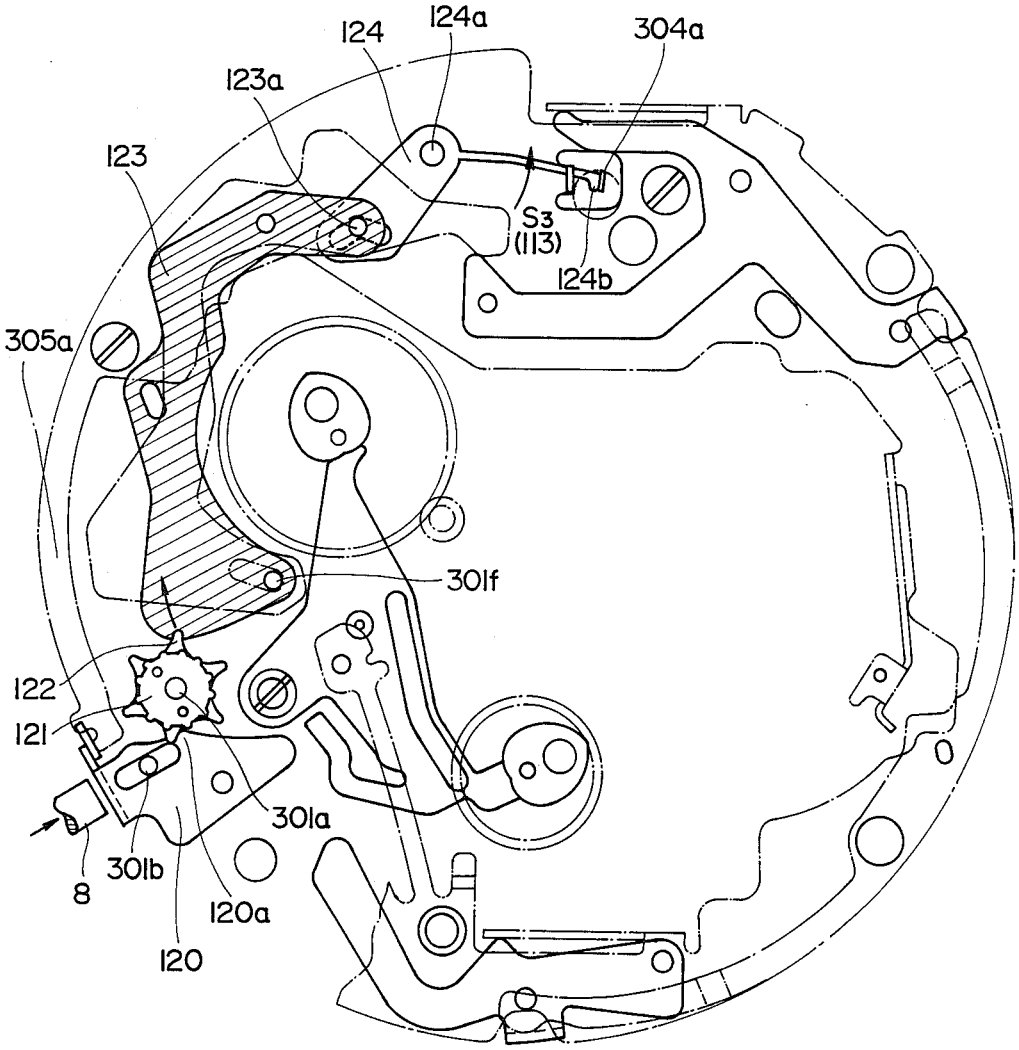
Figure 11:
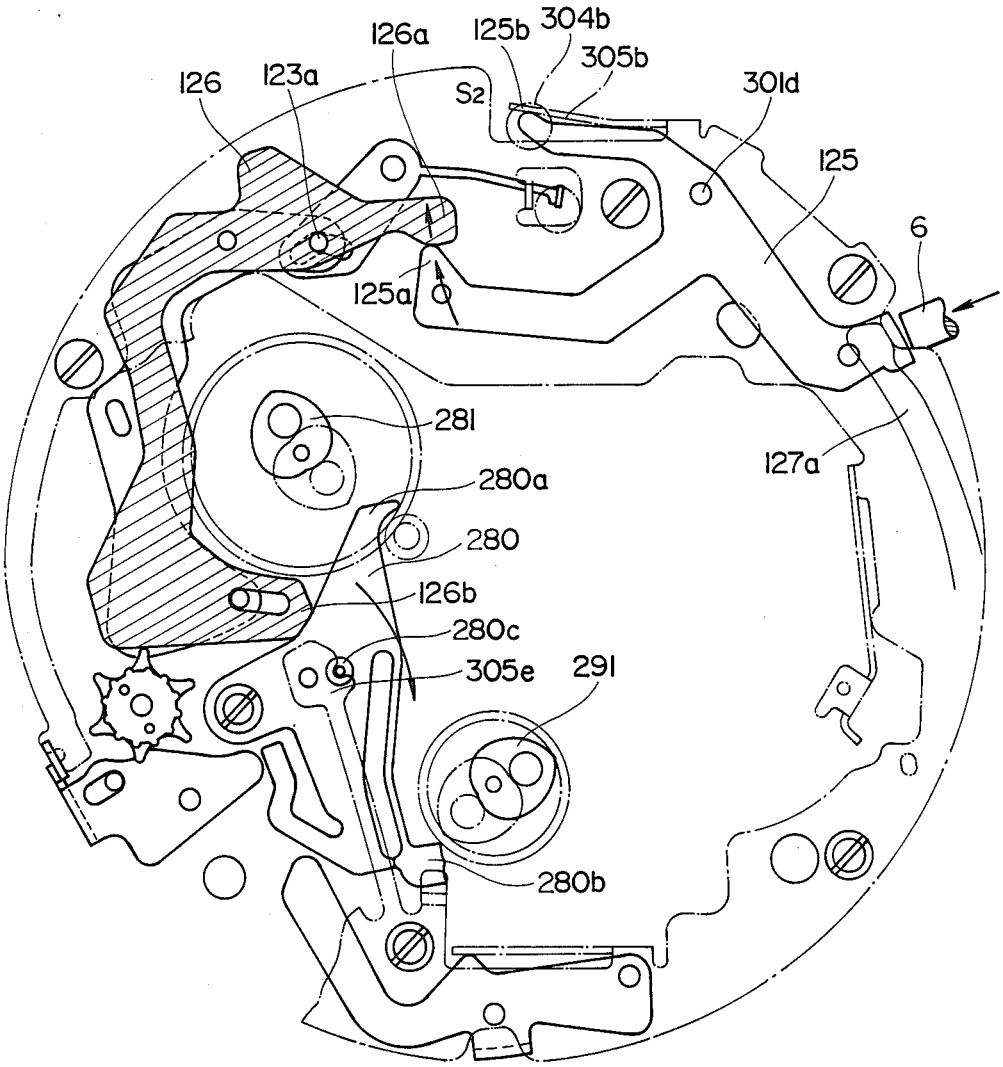

An actuating cam lever 123 (hatched lever in FIG. 10) rotatably mounted on a pin 301f secured to plate 301 engages with the lower wheel 122. The actuating cam lever 123 has a cam portion comprising two teeth 123*b*, 123*c* and a recess 123*d* between the teeth. The teeth 123*b* and 123*c* are shaped to engage two teeth of lower wheel 122, and recess 123*d* is adapted to be engaged with the tip end of the tooth of lower wheel 122 as shown in FIG. 10.

Mounted on an end of lever 123 is a pin 123*a* which is alternately located between a first position (FIG. 9) and second position (FIG. 10) in depending on the engagement state of the cam portion with the lower wheel 122. The pin 123*a* engages with a slit cam 124*c* of a switch lever 124 pivotally mounted on a pin 124*a*. The switch lever 124 has a movable contact 124*b* which is to be engaged with a fixed contact 304*a* on a circuit board 304 (FIG. 14), forming switch S3.

When the button 8 is depressed to push the actuating lever 120, the lower wheel 122 is rotated ½ pitch in the counterclockwise direction, so that the tip of tooth 122*b* engages with the recess 123*d* of the cam lever 123. Thus, the lever 123 is rotated clockwise to cause the switch lever 124 to rotate in the counterclockwise direction to engage the movable contact 124*b* with fixed contact 304*a* to close the switch S3. Thus, second hand 2 is rotated to the zero position by pulses of 64 Hz to initiate the chronograph mode.

Explaining a start/stop mechanism for the chronograph, a start/stop lever 125 is pivotally mounted on a shaft 301*d* secured to the plate 301 and urged in the counterclockwise direction by an end 127*a* of a spring plate 127. An end 125*a* of the start/stop lever 125 is positioned near an end 126*a* of a start/stop intermediate lever 126 (hatched lever in FIG. 11) which is pivotally mounted on the pin 123*a* secured to the actuating lever 123. Another end 125*b* of lever 125 engages with a movable contact 305*b* formed in bridge 305, which forms the switch S2 together with a fixed contact 304*b* (FIG. 13). Another end 126*b* of the lever 126 is located near the hammer 280.

When the start/stop button 6 is depressed, the start/-stop lever 125 is rotated to clockwise push the end 126*a* of the lever 126, so that the lever 126 rotates in the counterclockwise direction. The end 126*b* of the lever 126 engages with the hammer 280 to rotate it clockwisely to remove ends 280*a* and 280*b* from hearts 281 and 291 to release shafts 284 and 290. On the other hand, the end 125*b* of the lever 125 pushes the movable contact 305*b* to engage it with the fixed contact 304*b* to close the switch S2 to rotate the second-hand motor 21 at the rate of one step per second by 1 Hz pulses. In such a state, the pin 280*c* of the hammer 280 engages with a notch 305*h* of the spring arm 305*e*. Accordingly, CG minute hand 4 and hour hand 3 also start to rotate in synchronism with the second wheel 241.

When the start/stop button 6 is pushed again, switch S2 is closed again to stop the motor 21 as described above. Cn the other hand, although the intermediate lever 126 is rotated, the hammer 280 is not rotated, because the hammer is held at the position of FIG. 11 by the engagement of pin 280*c* with notch 305*h*.

The CG 2/100-second hand motor 22 independently starts and stops by the operation of the push button 6 to indicate 2/100 second. Thus, elapsed time can be measured.

Figure 12:
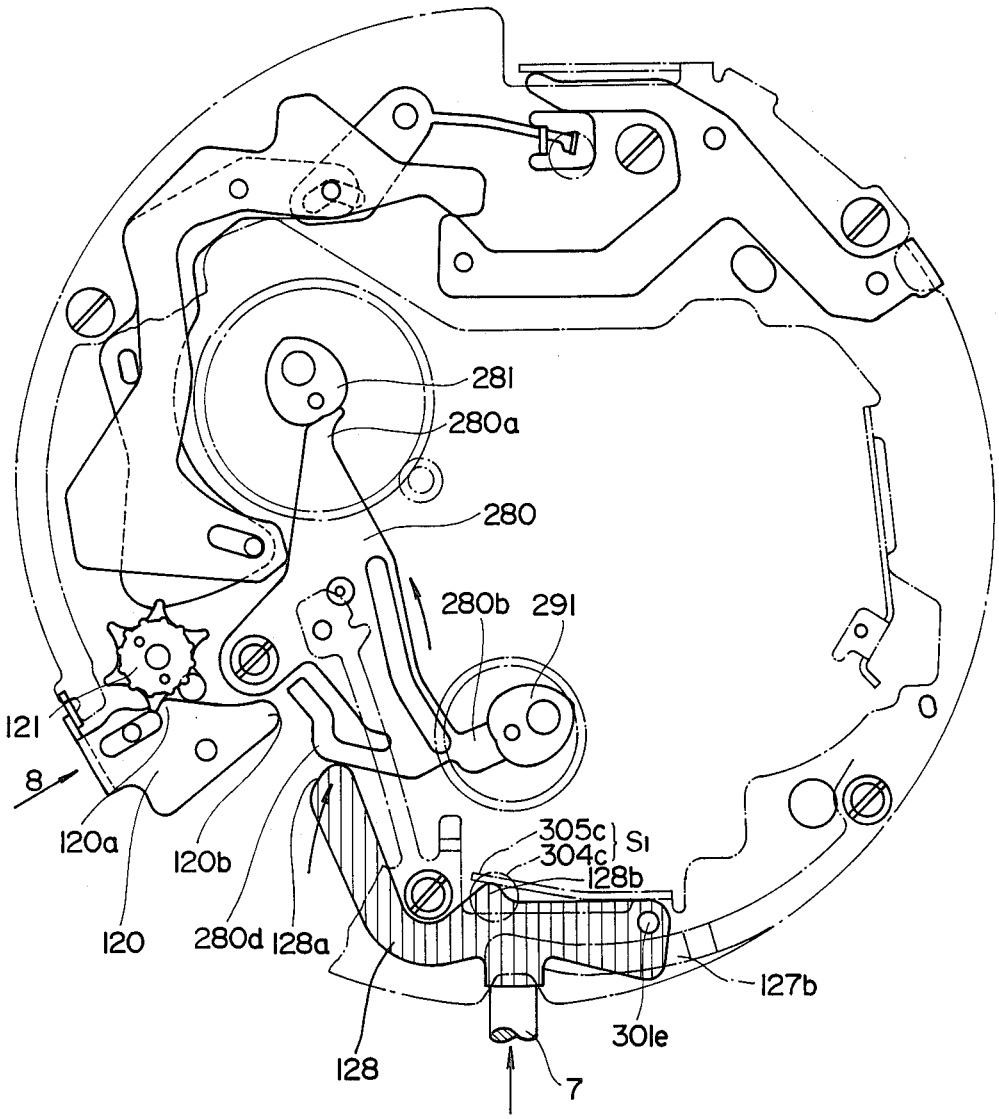

Referring to FIG. 12, a reset lever 128 (hatched lever) is pivotally mounted on a shaft 301*e* and biased to the set/reset button 7 by an end 127*b* of spring plate 127. The reset lever 128 has an end 128*a* adapted to be engaged with an end 280*d* of hammer 280 and another end 128*b* adapted to be engaged with a movable contact 305*c* which forms the switch S1 together with a fixed contact 304*c*.

When the set/reset button 7 is pushed, irrespective of modes of chronograph operation, the reset lever is rotated clockwise, so that the end 128*a* engages with end 280*d* to rotate the hammer 280 in the counterclockwise direction. Accordingly, actuating ends 280*a* and 280*b* engage with hearts 281 and 291 to rotate shafts 284 and 290 to the zero positions. At the same time, the other end 128*b* pushes the movable contact 305*c* to fixed contact 304*c* to close the switch S1. Thus, the second hand 2 rotates to the zero position. If the start/stop button 6 is pushed, chronograph operation restarts.

When changeover button 8 is pushed, irrespective of chronograph operation modes such as chronograph start, stop and reset, end 120b of actuating lever 120 engages with end 280*d* of hammer 280, causing it to rotate counterclockwisely. Accordingly, actuating ends 280*a* and 280*b* engage with hearts 281 and 291 to return hands 3 and 4 to zero positions. On the other hand, upper and lower wheels 121 and 122 are rotated by pawl 120*a*, so that teeth 123*b* and 123*c* engage between teeth of the lower wheel 122. Thus, the cam lever 123 rotates in the counterclockwise direction to the position of FIG. 9 to open the switch S3. Accordingly, second hand 2 returns to the normal time position at the rate of 64 Hz.

Under such a normal time indicating condition, if the set/reset button 7 is pushed to close the switch S1, CG 2/100-second hand 5 is rotated to a desired position, so that the timer is set. Thereafter, when the start/stop button 6 is pushed to close switch S2, the timer operates during the set time. During such a operation, although levers 128 and 125 are rotated by buttons 7 and 6, ends 128*a* and 125*a* do not engage with hammer 280 and lever 126. Accordingly, the normal time indicating condition does not change.

While the invention has been described in conjunction with preferred specific embodiment thereof, it will be understood that this description is intended to illustrate and not limit the scope of the invention, which is defined by the following claims.

What is claimed is:

1. An electronic timepiece with a chronograph system having second, minute and hour hands, a chronograph minute hand and a chronograph hour hand, comprising:

a standard oscillator for producing standard pulses;

a frequency divider for dividing the standard pulses into first pulses having a low frequency and second pulses having a high frequency;

a first motor for driving the second hand;

a second motor for driving the minute hand and hour hand;

driver means responsive to the first and second pulses for driving the first and second motors;

a gear train for transmitting the output of the first motor to the second hand, chronograph minute hand, and chronograph hour hand;

a resetting mechanism for resetting the chronograph minute hand and chronograph hour hand to respective zero positions;

first circuit means responsive to the second pulses for operating the first motor to reset the second hand to the zero position;

second circuit means for starting and stopping the first motor;

external manipulating means for operating the resetting mechanism, first and second circuit means and for changing a normal time display mode to a chronograph time display mode.

2. The electronic timepiece according to claim 1 wherein the resetting mechanism comprises hearts secured to shafts of respective hands, a fly-back lever engaged with the hearts for rotating the hands to the zero positions, and slipping mechanisms for allowing the resetting operation.

3. The electronic timepiece according to claim 1 wherein the second hand is provided for indicating both the normal time and chronograph time.

4. The electronic timepiece according to claim 1 wherein the external manipulating means includes a changeover switch for alternately changing the mode of operation between the normal time display mode and the chronograph reset state.

5. The electronic timepiece according to claim 3 wherein the external manipulating means includes a start/stop switch for alternately starting and stopping the chronograph operation.

6. The electronic timepiece according to claim 2 wherein the first and second circuit means comprise counters and checking circuit means for rotating the second hand to the zero position and for coinciding the second hand position with the normal time.

* * * * *